United States Patent [19]

Vidler

[11] B 3,990,645

[45] Nov. 9, 1976

[54] CONTINUOUS SPOOLING APPARATUS

[75] Inventor: Edward Charles Vidler, Rochester, England

[73] Assignee: Winget Limited, Rochester, England

[22] Filed: Nov. 29, 1973

[21] Appl. No.: 420,321

[44] Published under the second Trial Voluntary Protest Program on March 30, 1976 as document No. B 420,321.

[30] Foreign Application Priority Data

Dec. 1, 1972 United Kingdom ..... 55508/72

[52] U.S. Cl. ..... 242/25 A

[51] Int. Cl.[2] ..... B65H 67/04

[58] Field of Search ..... 242/25 A, 25 R, 18 A

[56] References Cited

UNITED STATES PATENTS

| | | | |
|---|---|---|---|
| 2,932,462 | 4/1960 | Nelson | 242/25 A |
| 3,323,735 | 6/1967 | Diehl | 242/25 A |
| 3,721,393 | 3/1973 | Croisettere | 242/25 A |

FOREIGN PATENTS OR APPLICATIONS

| | | | |
|---|---|---|---|
| 1,199,734 | 7/1970 | United Kingdom | 242/25 A |

*Primary Examiner*—Stanley N. Gilreath

[57] ABSTRACT

In a continuous spooling apparatus for wire having two co-axially spaced reels and a distributor head for delivering the wire to the reels, a wire carrier having a pivotal cradle is positioned intermediate the empty and full reels for receiving the wire upon transfer of the feed of the wire from toward the full reel to toward the empty reel by the distributor head, the carrier rotates from a position adjacent the distributor head to a position approaching a cutter diametrically opposite the distributor head where the cradle is pivoted to release the wire to be snagged by notched catcher plates positioned at adjacent flanges of the full and empty reels.

4 Claims, 6 Drawing Figures

CONTINUOUS SPOOLING APPARATUS

This invention relates to continuous spooling apparatus for wire and similar strands and, more particularly, to apparatus in which co-axially spaced, independently driven, reels are driven in sequence at a varying rate of rotation, such that the peripheral speed at the surface of the wound strand remains constant, to receive the strand and, when filled, removed from the apparatus, means being provided to transfer the strand feed from a full reel to an empty reel and to sever the strand at a location intermediate the reels. Severing of the strand is effected by catching a length of the strand in notches on catching plates abutting the adjoining reel flanges and carrying the length of strand round to contact a stationary cutter. However, unless severance is effected very shortly after the strand is caught in the notches undue tension is placed on the strand arising from the necessarily different speeds of rotation of the empty and full reels.

Accordingly, it has in the past been proposed to provide arcuate flange protective means arranged, during transfer of a strand from a rotating full reel to a rotating empty reel, to prevent the strand initially contacting the catching plates and further means arranged to force the strand along and off the flange protective means to a position in which a length of the strand is caught and carried round in notches in the catching plates and to contact a stationary cutter.

According to the present invention there is provided continuous spooling apparatus for wire and similar strands having co-axially spaced, independently driven, removable, reels arranged to receive the strand from a distributor head and to be driven in sequence at a varying rate of rotation such that the peripheral speed at the surface of the wound strand remains constant, means for transferring discharge of the strand from the distributor head from toward a full reel to toward an empty reel, notched catcher plates abutting adjacent flanges of the full and empty reels to catch the strand and sever the strand against a stationary cutter, a wire carrier positioned intermediate the empty and full reels rotatable co-axially with the reels from a position adjacent the distributor head receiving the strand upon transfer of the feed from toward the full reel to toward the empty reel and holding the strand clear of the notched catcher plates to a position adjacent the cutter releasing the strand to the notched catcher plates.

Preferably, the wire carrier is of cradle form and is pivotable between a position in which the strand is retained on the cradle and a position in which the strand is released from the cradle.

The invention will now be described, by way of example, with reference to the accompanying, partly diagrammatic, drawings, in which.

Figure 1:
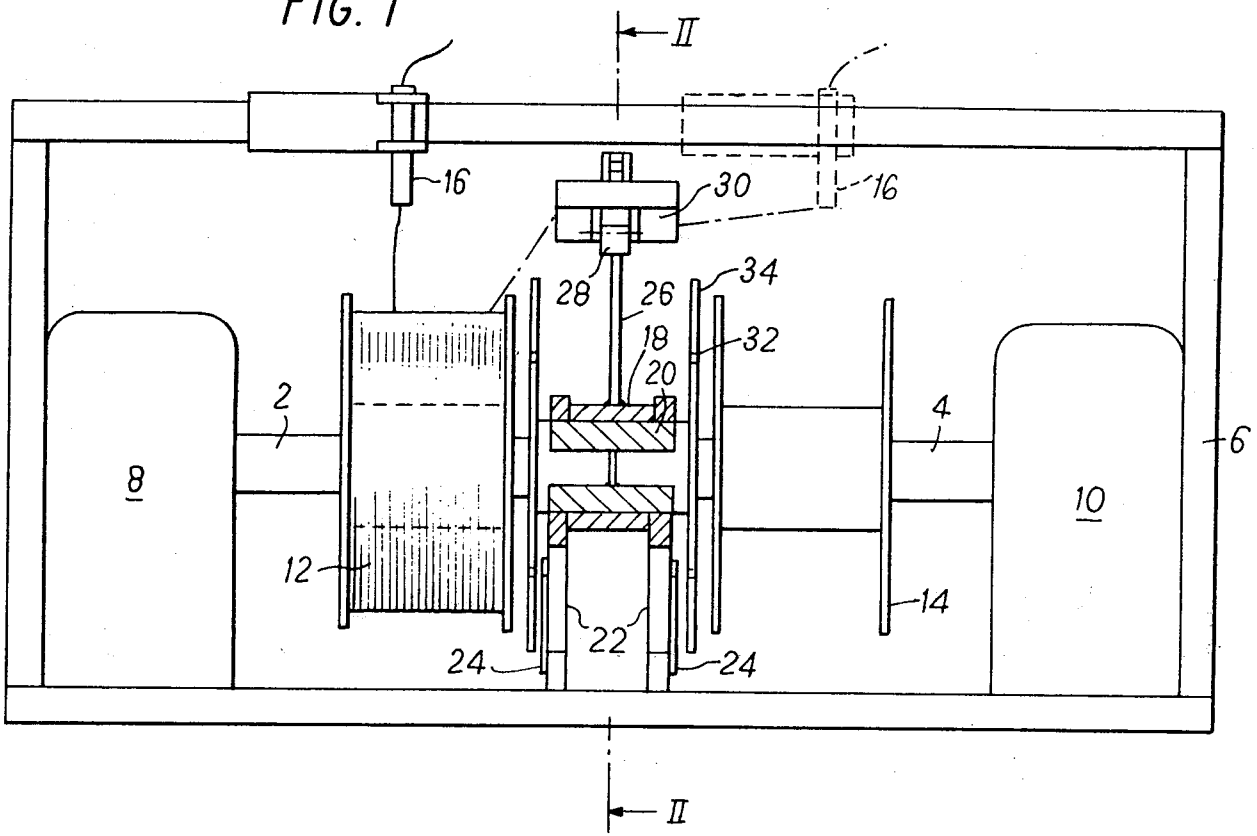
FIG. 1 is a partly cross-sectional side elevation of a continuous spooler.
Figure 2:
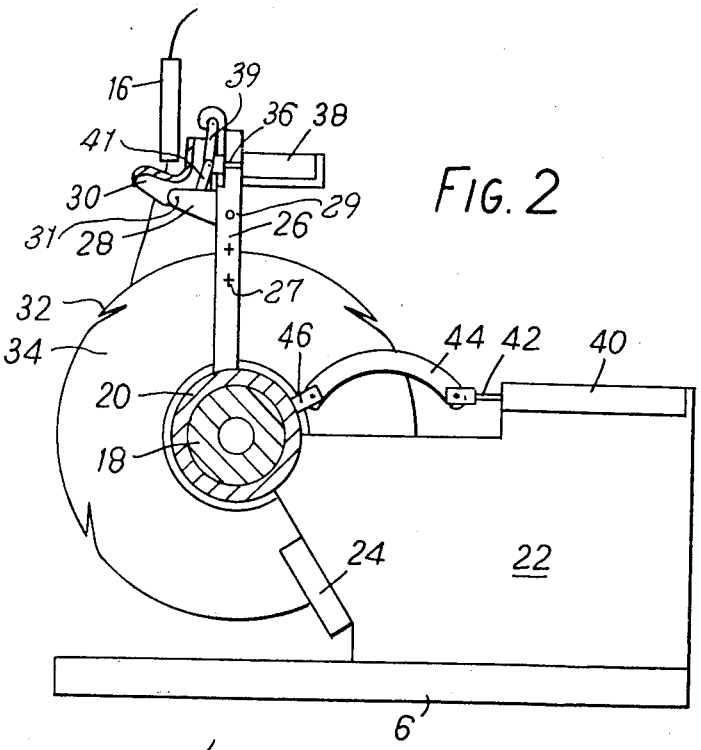
FIG. 2 is a cross-sectional elevation taken at the line II—II of FIG. 1.

Referring to FIGS. 1 and 2, there is shown a continuous spooler including a pair of co-axially extending, spaced arbors 2, 4 mounted in a frame 6. Each arbor is provided with a variable speed drive 8, 10 and is axially movable to permit the positioning and removal of reels 12,14 thereupon. A reciprocable, traversing, wire feed tube mechanism 16 is also mounted on the frame to supply wire to a reel on either one of the arbors at a constant linear speed, with a reciprocating motion across the surface of the reel and is traversable to supply wire to a reel on the other of the arbors. Regulating means (not shown) are provided to effect regulation of the speed of rotation of the arbors such that the peripheral speed at the wire surface of a reel is the same as the linear rate of supply of the wire so that the wire is neither stretched nor permitted to go slack during reeling.

Locating the adjacent ends of the arbors 2,4 a boss 18 forming part of a changeover mechanism is positioned, co-axially with the arbors, in a collar 20 provided on a centre bracket assembly 22 also serving as a mounting for cutters 24. A support arm 26 with spaced bolt holes 27 extending from the boss carries, as shown at the outer end thereof, a bracket 28 clamped thereto by a bolt 29 co-acting with one of the bolt holes 27, and a cradle-shaped wire carrier 30 pivotted at 31 on the bracket. The wire carrier 30 is pivotable between a position in which the wire is retained upon the carrier, clear of notches 32 on catching plates 34 abutting the reel flanges by virtue of the shape of the carrier, and a position in which the wire may fall from the carrier, by actuation of a piston rod 36 of a pneumatic cylinder 38, against a spring bias, the rod being linked to a link 41 pivotted on the carrier and to a link 39 pivotted on the bracket 28 the cylinder also being pinstably mounted on the bracket 28. A double acting pneumatic cylinder 40, mounted on the centre bracket assembly 22, has a piston rod 42 connected through a curved link 44 to a lug 46 positioned on the boss 18 and is actuable to rotate the boss through 120° to a position in which the wire carrier is adjacent the cutter 24. Return of boss 18 to the initial position is effected by applying actuating pressure to the opposite side of the pneumatic cylinder 40 or, if a single acting cylinder is used, by biassing the support arm toward the initial position by means of a counterweight (not shown). The wire carrier 30 is spring biassed to return to the initial position upon venting the associated pneumatic cylinder 38.

In operation, wire is fed at a constant speed from the reciprocating, wire distributor tube to one of the reels which is driven to give a constant peripheral speed at the surface of the reeled wire. Upon the reel reaching a pre-determined dimension, a change-over sequence is initiated. The drive to the other arbor, carrying an empty reel, is energised to bring the reel up to speed and the wire distributor tube is traversed, trailing the wire over the cradle form of the wire carrier, to reciprocate above the empty reel. However, the wire continues to be wound on the full reel since the cradle form of the wire carrier directs the wire from the wire distributor tube to the full reel. The pneumatic cylinder 40 on the centre bracket assembly is then actuated to rotate the boss and, thus the wire carrier, through 120°. Upon reaching the limit of travel adjacent the cutter 24, the pneumatic cylinder 38 associated with the wire carrier is actuated to pivot the wire carrier to permit dis-engagement of the wire therefrom. Immediately following dis-engagement the wire is caught in notches 32 in the rapidly rotating catching plate and carried about 60° around the boss to be severed upon the cutter on the centre bracket assembly.

It will be understood that there is sufficient tolerance in the wire feed to accommodate the movement of the distributor head and the wire carrier without causing undue straining of the wire. Since the wire distributor tube is above the empty reel and the wire is held in a notch in the associated catcher plate wire then commences reeling on to the empty reel. The full reel is braked and handling means inserted under the reel. The associated arbor is then moved axially and the full reel removed and replaced by an empty reel to permit continuation of the sequence, the boss and wire carrier being returned to their initial positions either by applying vacuum to the pneumatic cylinders or by means of a counterweight and a positioning pawl.

Figure 4:
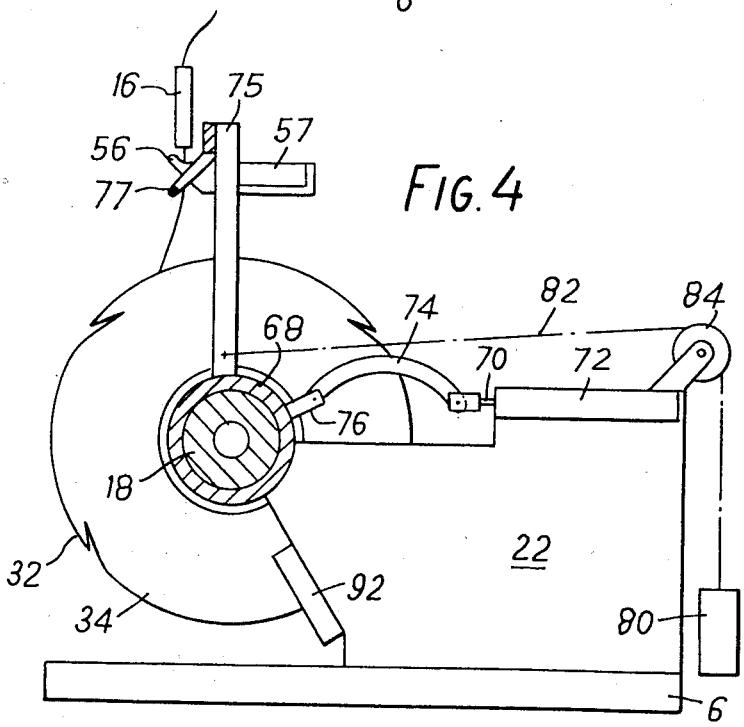
FIG. 4 is a cross-sectional elevation taken on the line IV—IV of FIG. 3.
Figure 3:
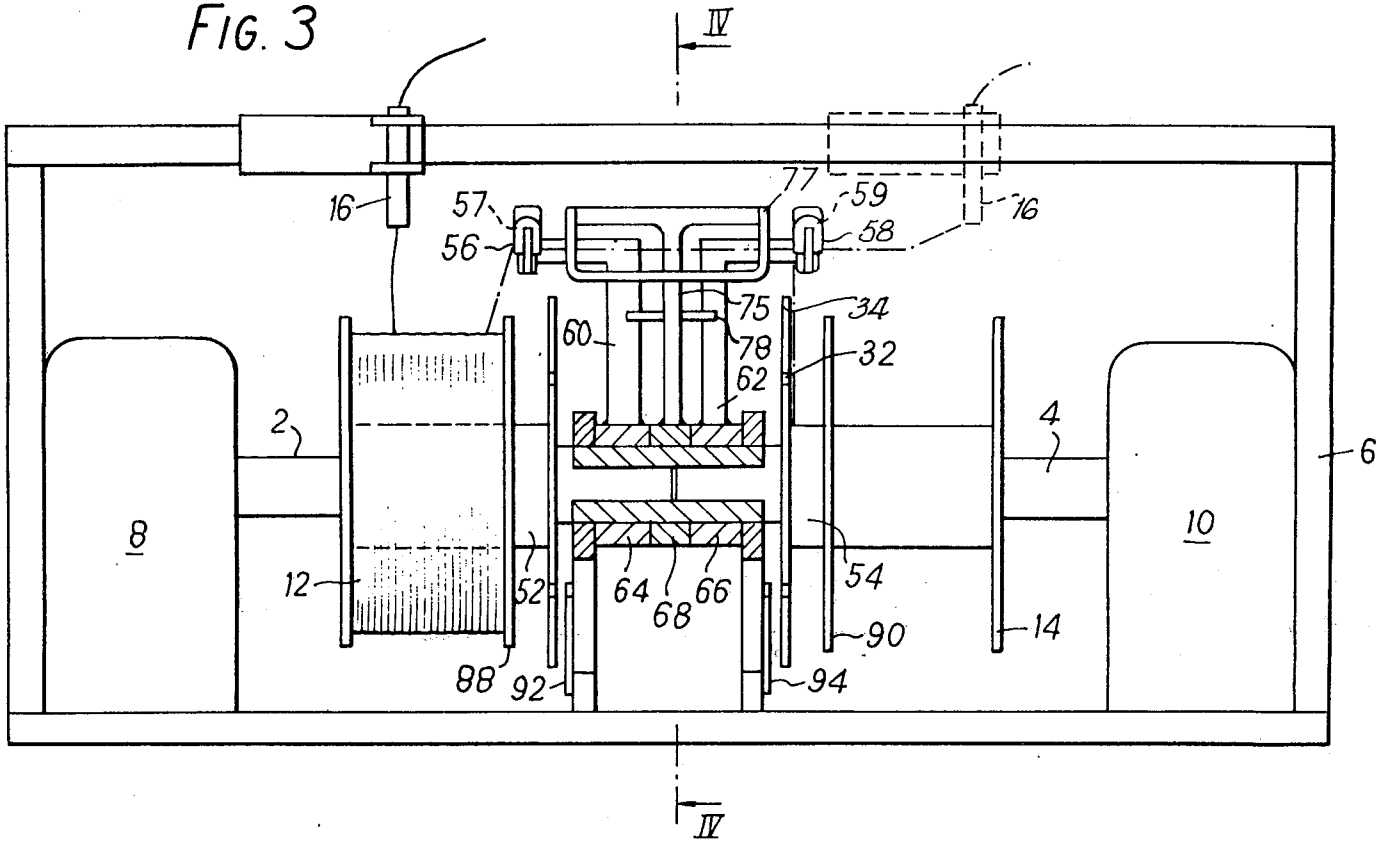
FIG. 3 is a partly cross-sectional side elevation of a modified form of continuous spooler.
Figure 5:
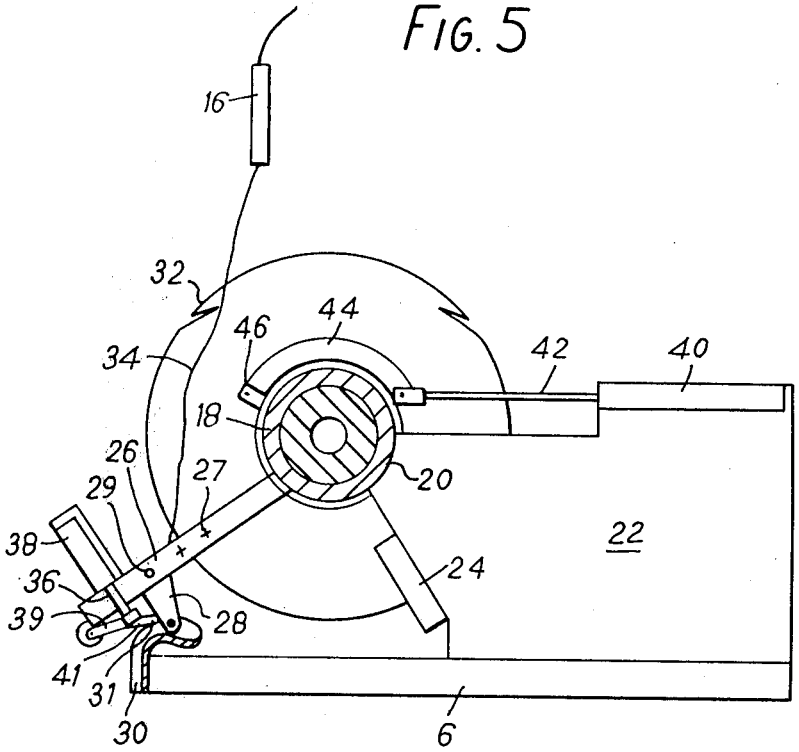
FIG. 5 is a cross-sectional elevation similar to FIG. 2 showing the wire carrier in a pivoted wire release position.
Figure 6:
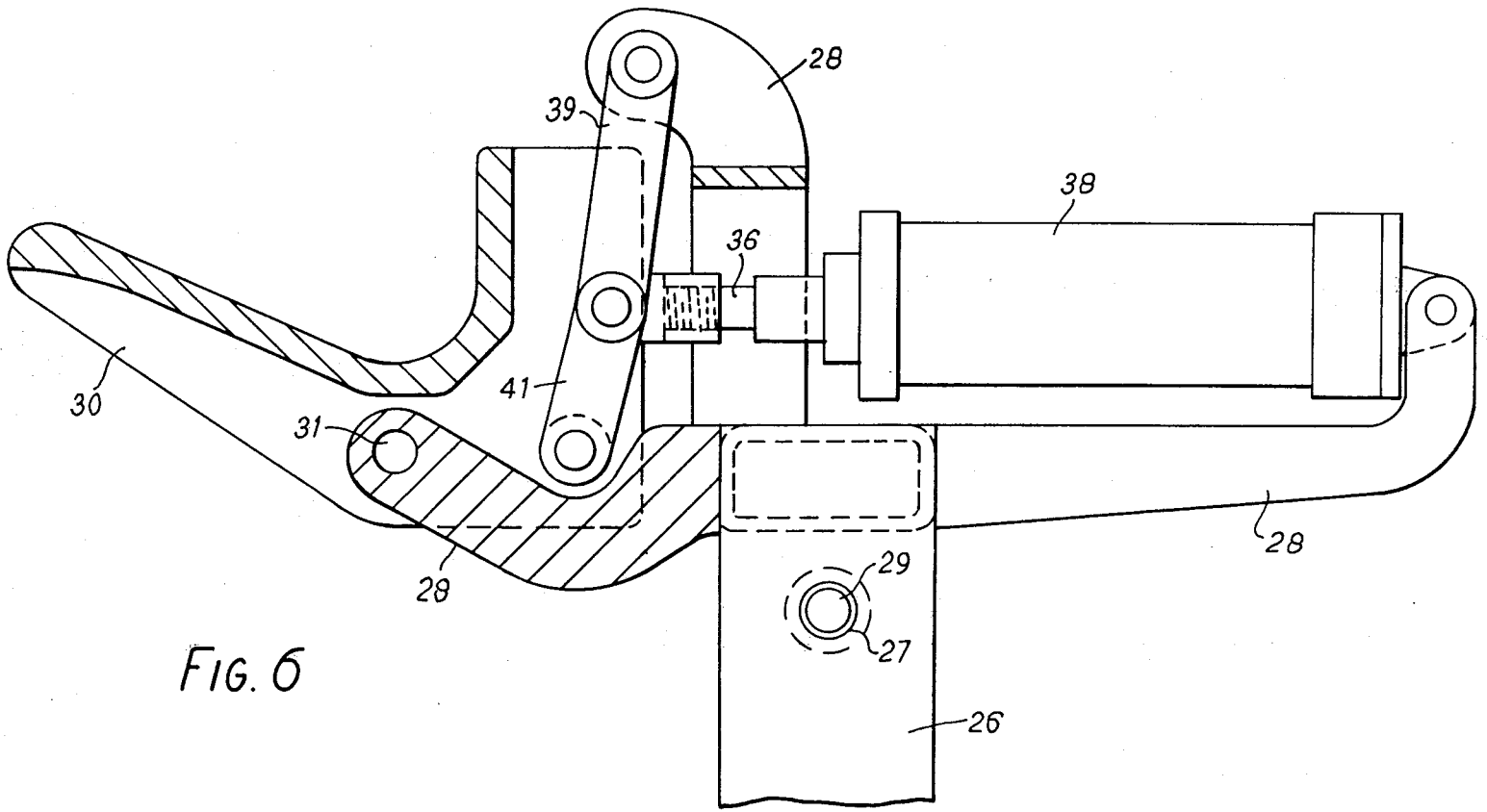
FIG. 6 is an elevational view, partly in crosssection, of the wire carrier of FIG. 2.

If it is required to provide a length of wire leading-in to the inner portion of the reel, for use in subsequent operations, as is shown in FIGS. 3,4 collector or dummy reels 52, 54 are positioned intermediate the reels 12, 14 and the notched catcher plates 34. The changeover mechanism is modified by the provision of outer wire carriers 56, 58 and actuating pneumatic cylinders 57, 59 on outer support arms 60, 62 carried on bosses 64, 66 positioned to either side of a central boss 68. Each outer support arm boss 64, 66 is connected to respective piston rods 70 of pneumatic actuating cylinders 72, through curved links 74 and lugs 76. The central boss 68 carries a central support arm 75 provided with a fixed central wire saddle 77 and spigots 78 positioned to either side to co-act with the outer support arms 60, 62 such that upon actuation of the appropriate pneumatic cylinder 72 to rotate one of the outer arms toward the cutter 24, the central support arm 75 is also rotated. A counterweight 80 is connected to the central support arm by a cable 82 running over a pulley block 84 on the centre bracket assembly 22 thereby biassing the central support arm toward the initial position. The rotatable wire carriers 56 are of the same form as the wire carrier 30 described in connection with FIGS. 1 and 2 respectively positioned in radial alignment with flanges 88, 90 between the associated reel 12 or 14 and the dummy reel 52 or 54. Cutters 92, 94 are positioned adjacent the dummy reels 52, 54.

In operation, the sequence is similar to that described previously in connection with FIGS. 1 and 2. Upon traversing of the wire distributor 16 to above the empty reel 14, the wire is carried on the respective wire carriers clear of the catching plates 34. The pneumatic cylinder 72 of the outer support arm 60 adjacent the full reel is then actuated to rotate that outer support arm and, by the outer support arm 60 bearing on the spigot 78 the central support arm 75, through 120° to adjacent the cutters 92, 94. The rotatable carrier 56 is then rotated to permit disengagement of the wire both thereform and from the fixed saddle 77 on the central support arm. The wire is caught in the notches in the catching plates at the ends of the collector reels and severed against the cutter 94. Since the outer support arm 62 associated with the empty reel 14 is still in the initial position wire runs over the associated wire carrier 58 and is wound onto the collector reel 54 of the empty reel 14 until the outer support arm 62 is rotated by actuation of the associated pneumatic cylinder 72 towards the cutter 94. At this location the wire carrier

58 is rotated and the wire transfers off the carrier 58 and onto the empty reel 14, since the wire distributor is above the reel 14 there being sufficient tolerance in the wire feed to accommodate the transfer. The pneumatic cylinders 72 are then actuated to return the outer support arms and the rotatable carriers to the initial position, the counter-weight bias effecting return of the central support arm 75 to the intial position upon return of the outer support arms.

It will be appreciated that the form of the wire carrier is such that a range of diameters of reel flanges may be accommodated without adjustment of the wire carrier being necessary. When adjustment is necessary it may easily be effected by altering the radial position of the wire carriers on the arms to conform with the reel flange diameter.

In a modification (not shown) rotation of the or each rotatable wire cradle is effected by a latch push rod and spring mechanism actuated by stops on the centre bracket assembly at the limits of travel of the support arm. The push rod is slidably mounted on and extends along the or each support arm and is biassed by means of a tension spring to a position in which the wire may fall from the carrier. A latch retains the push rod in a position in which the carrier is in a position retaining the wire. The latch is released by abutment against a stop adjacent the cutter and is re-set by abutment against a stop adjacent the initial positions of the support arm, a cam face being positioned to return the carrier to the initial position immediately prior to engagement of the latch.

I claim:

1. Continuous spooling apparatus for wire and similar strands having two co-axially spaced, independently driven, removable reels, a distributor head arranged to deliver the strand to the reels, variable drive means for the reels permitting the reels to be driven in sequence at a varying rate of rotation such that the peripheral speed at the surface of the wound strand remains constant, means for transferring discharge of the strand from the distributor head from toward a full reel to toward an empty reel, notched catcher plates positioned adjoining adjacent flanges of the full and empty reels and rotatable therewith, stationary cutters positioned approximately diametrically opposite to the distributor and adjacent respective catcher plates arranged to sever the strand, a wire carrier of pivotable cradle form positioned intermediate the empty and full reels rotatable co-axially with the reels from a position adjacent the distributor head receiving the strand upon transfer of the feed from toward the full reel to toward the empty reel to a position approaching the cutter, the wire carrier including a cradle pivotable between a retaining position in which the strand is retained by the cradle irrespective of the position of the wire carrier and is held clear of the notched catcher plates and a release position in which the strand is released to the notched catcher plates.

2. Continuous spooling apparatus as claimed in claim 1, wherein the wire carrier is movably mounted upon an arm on a rotatable boss arranged co-axially of the reels the arm being provided with spaced bolt holes permitting clamping of the wire carrier at selectable radii corresponding to an alteration in the radii of the notched catcher plates.

3. Continuous spooling apparatus for wire and similar strands having two co-axially spaced, independently driven, removable reels, each provided with a flanged collector section for receiving an initial length of the strand prior to the strand being wound on the associated reel, a distributor head arranged to deliver the strand to the reels, variable drive means for the reels permitting the reels to be driven in seqence at a varying rate of rotation such that the peripheral speed at the surface of the wound strand remains constant, means for transferring discharge of the strand from the distributor head from toward a full reel to toward an empty reel, notched catcher plates positioned adjoining adjacent flanges of the full and empty reels and rotatable therewith, stationary cutters positioned approximately diametrically opposite to the distributor and adjacent respective catcher plates arranged to sever the strand, wire carriers of pivotable cradle form positioned in register with the respective collector sections independently rotatable co-axially with the reels from a position adjacent the distributor head receiving the strand upon transfer of the feed from toward the full reel to toward the empty reel to a position approaching the cutter, each wire carrier including a cradle pivotable between a retaining position in which the strand is retained by the cradle irrespective of the position of the wire carrier and is held clear of the notched catcher plates and a release position in which the strand is released to the notched catcher plates, rotation of the wire carrier adjacent the full reel together with appropriate pivotting of the cradle serving to transfer the strand from the full reel to the collector section of the empty reel and rotation of the wire carrier adjacent the empty reel together with appropriate pivotting of the cradle serving to transfer the strand from the collector section of the empty reel to the empty reel.

4. Continuous spooling apparatus as claimed in claim 3, wherein a fixed central wire saddle is positioned intermediate the pivotable cradles and is rotatable co-axially therewith to assist transfer of the strand from the full reel to the collector section of the empty reel.

* * * * *